US007606716B2

(12) United States Patent
Kraemer

(10) Patent No.: US 7,606,716 B2
(45) Date of Patent: Oct. 20, 2009

(54) SYSTEMS AND METHODS FOR MULTI-DIALOG SURROUND AUDIO

(75) Inventor: Alan D. Kraemer, Irvine, CA (US)

(73) Assignee: SRS Labs, Inc., Santa Ana, CA (US)

( * ) Notice: Subject to any disclaimer, the term of this patent is extended or adjusted under 35 U.S.C. 154(b) by 0 days.

(21) Appl. No.: 11/774,991

(22) Filed: Jul. 9, 2007

(65) Prior Publication Data

US 2008/0015867 A1 Jan. 17, 2008

Related U.S. Application Data

(60) Provisional application No. 60/819,048, filed on Jul. 7, 2006.

(51) Int. Cl.
*G10L 19/00* (2006.01)

(52) U.S. Cl. ..... 704/500; 704/501; 704/503; 381/20; 381/19

(58) Field of Classification Search ..... 704/500–504, 704/227, 228, 278; 381/20, 19, 21
See application file for complete search history.

(56) References Cited

U.S. PATENT DOCUMENTS

| | | | | |
|---|---|---|---|---|
| 5,771,295 | A | 6/1998 | Waller | |
| 6,694,027 | B1 * | 2/2004 | Schneider | 381/20 |
| 7,200,236 | B1 | 4/2007 | Klayman et al. | |
| 7,266,501 | B2 * | 9/2007 | Saunders et al. | 704/500 |
| 7,277,767 | B2 | 10/2007 | Yuen et al. | |

* cited by examiner

*Primary Examiner*—Huyen X. Vo
(74) *Attorney, Agent, or Firm*—Knobbe, Martens, Olson & Bear, LLP

(57) ABSTRACT

Systems and processes for transmission of multi-channel audio from a sender to one or more recipients. Multi-channel audio is encoded with a plurality of different dialog channels. The encoded multi-channel audio and dialog channels can be compressed to facilitate transmission with limited bandwidth. A recipient can select a desired dialog channel from the plurality of dialog channels transmitted. A receiver side decoder can reconstruct a multi-channel audio with the selected dialog for playback. The plurality of dialog options can include different languages, different dialects, different accents, and/or different viewpoints/biases.

20 Claims, 3 Drawing Sheets

SYSTEMS AND METHODS FOR MULTI-DIALOG SURROUND AUDIO

CROSS-REFERENCE TO RELATED APPLICATIONS

This application claims the priority benefits of U.S. Provisional Application 60/819,048 filed Jul. 7, 2006 which is incorporated herein in its entirety.

BACKGROUND OF THE INVENTION

1. Field of the Invention

The invention relates to the field of multi-channel audio transmission and to systems and methods of providing a plurality of user selectable dialog channels in a multi-channel audio transmission.

2. Description of the Related Art

Increasing technical capabilities and user preferences have led to a wide variety of audio recording and playback systems. Audio systems have developed beyond the simpler stereo systems having separate left and right recording/playback channels to what are commonly referred to as surround sound systems. Surround sound systems are generally designed to provide a more realistic playback experience for the listener by providing sound sources that originate or appear to originate from a plurality of spatial locations arranged about the listener, generally including sound sources located behind the listener.

A surround sound system will frequently include a center channel, at least one left channel, and at least one right channel adapted to generate sound generally in front of the listener. Surround sound systems will also generally include at least one left surround source and at least one right surround source adapted for generation of sound generally behind the listener. Surround sound systems can also include a low frequency effects (LFE) channel to improve the playback of low frequency sounds. As one particular example, a surround sound system having a center channel, a left front channel, a right front channel, a left surround channel, a right surround channel, and a LFE channel is referred to as a 5.1 surround system.

One feature that is frequently desired in audio recording and playback is to have the audio available in multiple languages. For example, sports coverage, theatrical movies, video news reports, and many other types of audio content is of interest to a wide variety of people who may speak a corresponding wide variety of languages and/or local dialects. This need is frequently addressed in pre-recorded material by dubbing in a desired language channel with background or non-dialog audio, such as environmental sounds, engine noises, gunfire and explosions, crowd noise, etc. that would also be included with alternative audio with other languages. Thus, a consumer may watch pre-recorded programming stored on a storage medium such as a DVD and, upon play of the programming, select the desired language. For example, a user may select between English, French, and Spanish. Such systems typically require that the user select the desired language for the audio upon initial playback of the recorded programming. If the user subsequently wishes to select a different language, the systems generally require that the user halt the playback of the programming, select an alternative language, and restart playback of the programming.

In broadcast transmission of audio programming, it is known to provide a secondary audio programming (SAP) that a user can select to obtain a second alternative audio signal. A drawback to such systems are, however, that the listener is provided with a choice of only two language options, e.g., the primary and a single secondary audio option. A further drawback is that while the primary audio option is often provided in a stereo format, the secondary audio programming is typically limited to a monaural audio signal. Thus, a user desiring the secondary language option is not provided with the improved listening experience provided by multi-channel audio.

The approach taken with pre-recorded audio content that is subsequently replayed, for example DVD recordings, is not feasible with real-time streaming or broadcast transmission as such systems do not provide sufficient bandwidth to support multiple multi-channel audio signals. It will thus be appreciated that there exists a need for improved systems and processes for transmitting audio signals to allow an end user or recipient to have the option of multiple dialog choices while continuing to enjoy the audio experience of multi-channel surround sound. There is a particular need for dialog options in surround sound systems that can be employed in streaming or broadcast manner, for example, Internet streaming, broadcast television, cable television, and satellite television transmission.

SUMMARY OF THE INVENTION

The aforementioned needs are satisfied by certain embodiments which can include a sender side audio encoder that can receive a multi-channel surround sound audio input and encode the multi-channel surround sound audio with a plurality of different dialog channels for transmission. Certain embodiments include a receiver or recipient side decoder to decode received multi-channel surround sound audio and multiple dialog channels such that a user can select a desired dialog option and recreate surround sound audio with the selected dialog.

In various embodiments, a plurality of dialog options can include language options and/or dialect options. In certain embodiments, the dialog options can also provide a user the ability to select dialog or narration from different viewpoints. For example, in one embodiment, a multi-channel audio system can support transmission and recreation of sporting event coverage such that a user can select play by play and color commentary from a perspective that is favorable to their favored team.

At least certain embodiments also support compression of multi-channel audio signals and a plurality of different dialog channels in such a manner that the compressed signals are compatible with limited bandwidth transmission media, such as streaming Internet, broadcast television, cable television, and/or satellite-based television transmission. At least certain embodiments provide the further advantage that such limited bandwidth transmission media can be used with compressed and encoded surround sound audio signals such that a remote end user can enjoy recreated surround sound or pseudo-surround sound audio with their selected choice of dialog.

One embodiment includes a process for communicating multi-channel audio data, the process comprising encoding a first plurality of surround audio channels with a plurality of selectable dialog channels, transmitting the encoded first plurality of surround audio channels and selectable dialog channels from a sender to a recipient, decoding the encoded first plurality of surround audio channels and plurality of selectable dialog channels, selecting at least one of the selectable dialog channels, and mixing the at least one selected dialog channel with the decoded surround audio channels to obtain a second plurality of surround audio channels, the second plurality of surround audio channels including the selected dialog channel.

Another embodiment includes a multi-channel audio transmission system comprising a sender multi-channel encoder configured to encode a plurality of surround audio channels with a plurality of dialog channels and output the encoded surround audio and dialog channels, a transmission system arranged to receive the output from the sender encoder and to transmit the output to a recipient, and a recipient decoder configured to receive the output from the transmission system and to decode the plurality of encoded surround audio channels and dialog channels and mix the decoded surround audio channels with a selected one of the dialog channels to generate a plurality of surround audio channels with the selected dialog channel.

A further embodiment includes a multi-channel audio transmission system comprising means for encoding a first plurality of surround audio channels with a plurality of dialog channels and for outputting the encoded channels, means for transmitting the encoded first plurality of surround audio channels and dialog channels to a recipient, means for receiving the encoded first plurality of surround audio channels and dialog channels and for decoding the first plurality of encoded surround audio channels and dialog channels, and means for selecting one of the dialog channels and mixing the selected dialog channel with the plurality of encoded surround audio channels to generate a second plurality of surround audio channels, the second plurality of surround audio channels including the selected dialog channel. These and other objects and advantages of the invention will become more apparent from the following description taken in conjunction with the accompanying drawings.

DETAILED DESCRIPTION OF THE PREFERRED EMBODIMENT

Figure 1:
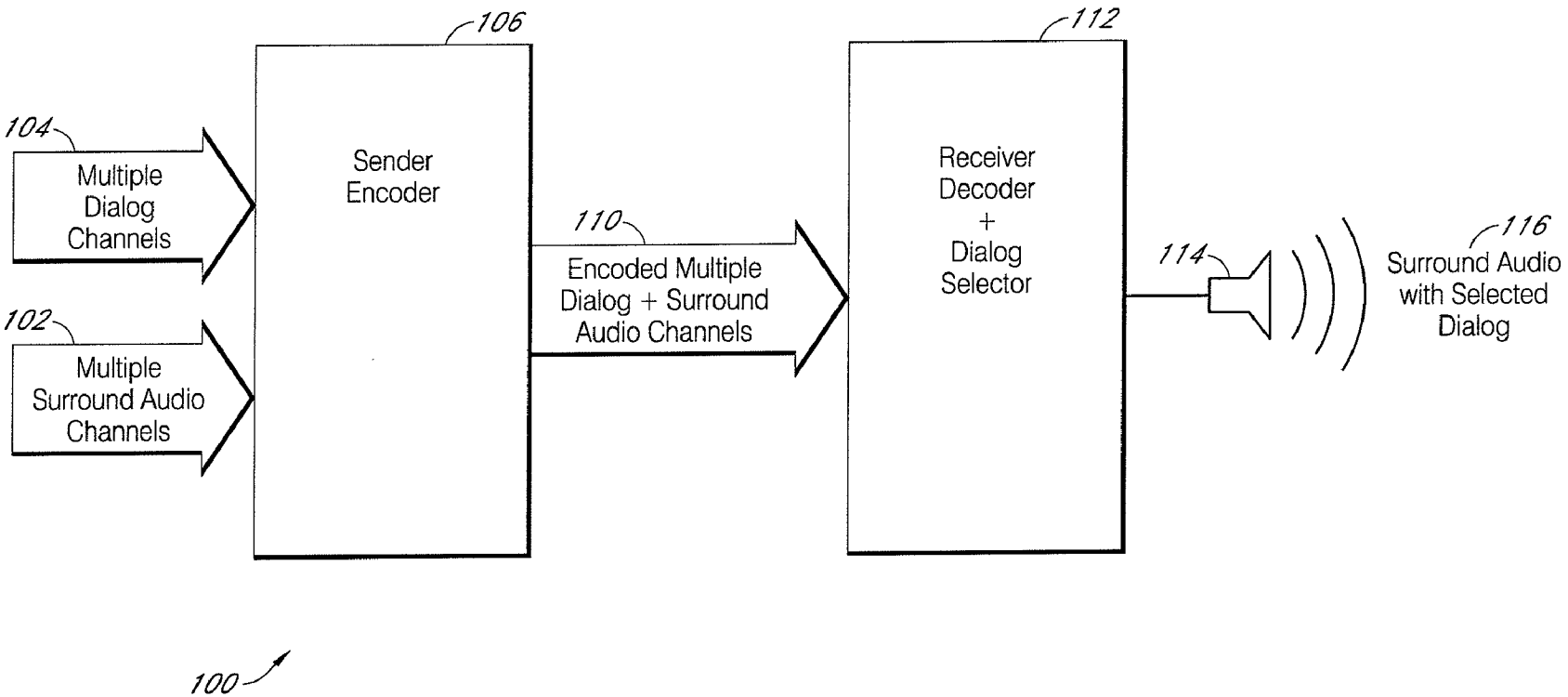
FIG. 1 is a high-level block diagram of one embodiment of a multi-dialog surround audio system.

Reference will now be made to the drawings wherein like reference designators refer to like components or processes throughout. FIG. 1 is a high-level functional block diagram of embodiments of a multi-dialog audio enhancement system 100 adapted to provide multi-dialog audio capabilities to a user. The system 100 is adapted to allow a user to select among a plurality of available dialog channels to obtain a desired dialog option while continuing to enjoy the audio qualities of a surround sound system when listening to broadcast or transmitted audio programming.

In one embodiment, the system 100 comprises incoming multiple surround audio channels indicated by the designator 102. The incoming multi-channel surround audio 102 can comprise one or more of a variety of multi-channel audio formats. The multi-channel surround audio 102 can include but is not limited to one or more of the Dolby digital, the digital theater system (DTS), Dolby Pro-Logic, Circle Surround, Sony SDDS, output from a multi-channel audio production console, or other multi-channel audio sources and formats. In one particular embodiment, the multi-channel surround audio 102 comprises a 5.1 surround audio format however with the center channel substantially removed therefrom. Thus, in one non-limiting embodiment, the incoming multi-channel surround audio 102 comprises a left channel, a right channel, a left surround channel, a right surround channel, and a low-frequency effects (LFE) channel.

In certain embodiments, the system 100 also comprises incoming multiple dialog channels 104. The multiple dialog channels 104 can comprise, in various embodiments, different narration channels associated with or corresponding to the incoming multiple surround audio channels 102. The multiple dialog channels 104 can comprise narration in different languages, narration in different dialects of a given language, and/or narration of different accents. In certain embodiments, the multiple dialog channels 104 can comprise a plurality of narratives in the same or different languages and/or dialects, however, of different viewpoints or perspectives. Thus, in one embodiment, the multiple dialog channels 104 can comprise play-by-play and color commentary associated with sports events coverage where the different dialog channels 104 present different enthusiast perspectives. Thus, a given dialog channel 104 can provide narrative that is favorable to a user's favorite sports team.

The system 100 further comprises a sender encoder 106 that is adapted to receive the incoming multi-channel surround audio 102 and the multiple dialog channels 104. In general, the sender encoder 106 is configured to receive the incoming multiple audio channels 102, 104 and appropriately encode the incoming audio signals for transmission from the sender to one or more recipients. In at least certain embodiments, the sender encoder 106 also performs one or more compression algorithms to facilitate transmission of data with reduced bandwidth. In at least certain embodiments, the sender encoder 106 also operates on the incoming audio channels 106, 104 so as to at least partially maintain reconstructible channel separation during any encoding and/or compression processes. For example, in certain embodiments, the sender encoder 106 may apply identifiable header information and/or identifying tones to designate and identify individual channels in a multi-channel compressed encoded audio signal.

In at least certain embodiments, the system 100 also comprises a transmission system 110. The transmission system 110 is adapted to transmit or convey audio signals from the sender encoder 106 to a recipient. In various embodiments, the transmission system 110 can comprise a networked communication system, such as the Internet. In other embodiments, the transmission system 110 can comprise an over-the-air broadcast system, such as can be employed for transmission of television signals, including but not limited to NTSC and high-definition television programming. In certain embodiments, the transmission system 110 can also comprise satellite based transmission systems and/or cable television transmission systems.

In at least certain embodiments, the transmission system 110 is subject to bandwidth limitations on signals conveyed by the transmission system 110. Thus, in at least certain embodiments, the sender encoder 106 is configured to appropriately encode and compress audio signals to accommodate any bandwidth limitations that might exist in the transmission system 110. It will be appreciated that in at least certain implementations, the transmission system 110 can comprise a plurality of different transmission media having different bandwidth and transmission requirements. Thus, the encoding and any compression performed by the sender encoder 106 can be adapted to the requirements of given applications and that these requirements may vary over time and location.

The system 100 also comprises a receiver decoder and dialog selector 112. The receiver decoder and dialog selector 112 is adapted to receive audio signals via the transmission system 110. In at least certain implementations, such audio signals have been subject to encoding and compression processes. The receiver decoder and dialog selector 112 is also adapted to appropriately decompress and decode received audio signals and to allow a user or recipient to select a desired dialog channel. As previously noted, the multiple dialog channels 104 can comprise different languages, different dialects, different accents, different narrative perspectives, etc. The receiver decoder and dialog selector 112 allows a user to indicate their desired dialog option and recreate the appropriate audio for playback.

In at least certain embodiments, the system 100 comprises a playback system 112 adapted to provide an audio recreation for the user. In certain embodiments, the playback system 114 comprises a plurality of speakers that can be arranged at different spatial locations about a listener to recreate sound in a surround sound manner. Thus, in one exemplary embodiment, the playback system 114 comprises a 5.1 surround sound system having a center speaker, left and right front speakers, left and right rear surround speakers, and an LFE speaker. In certain embodiments, the playback system 114 comprises a pseudo-surround system employing acoustic principles and principles of human hearing to emulate multipoint sound origination with a lesser number of speakers.

Thus, in at least certain embodiments, the system 100 is configured to receive a first plurality of multi-channel surround audio 102 that can have a center dialog channel substantially removed therefrom and selectively combine one of a plurality of dialog channels 104 to recreate a second plurality of surround audio channels 116 with the selected dialog. Thus, at least certain implementations of the system provide the ability of recreating surround audio with a desired dialog content 116 in an environment which may be subject to bandwidth limitations of a transmission system 110. Thus, the system 100 provides audio playback capabilities to a user while accommodating limits of a transmission system 110. The system 100 also supports real-time transmission and recreation of audio signals, such that a user can enjoy a real-time sports event broadcasting news, etc. while enjoying the advantages of a selectable dialog or narrative to accompany the broadcasting.

Figure 2:
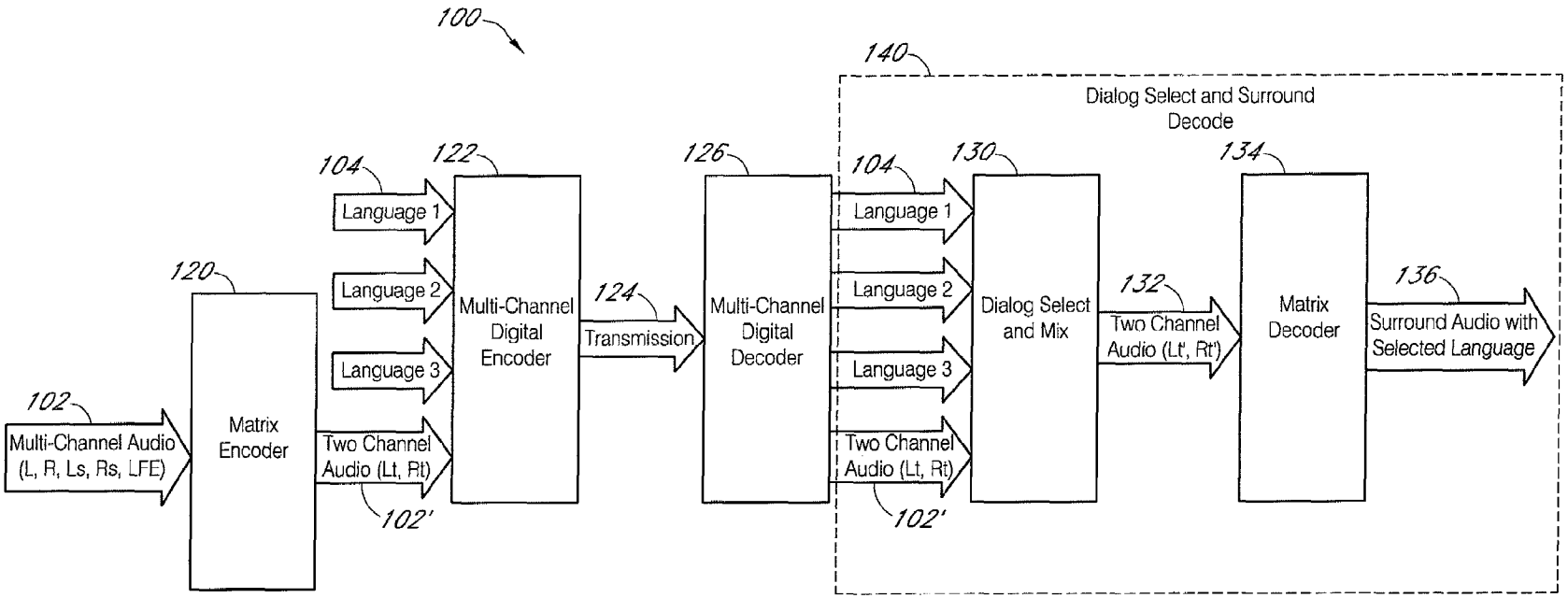
FIG. 2 is a more detailed block diagram of one embodiment of a multi-dialog surround audio system.

FIG. 2 is a more detailed functional block diagram of embodiments of a multi-dialog audio enhancement system 100. In one embodiment, the system 100 comprises incoming multi-channel surround audio 102 as previously described. In one embodiment, the incoming multi-channel surround audio 102 comprises a modified 5.1 surround audio format with the center channel thereof substantially removed. In certain embodiments, the system 100 further comprises a matrix encoder 120 arranged to receive the incoming multi-channel surround audio 102. The matrix encoder 120 is configured to perform a many to few matrix encoding algorithm on the incoming multi-channel surround audio 102. In one embodiment, the matrix encoder 120 comprises a Circle Surround encoder that is adapted to receive five incoming channels of surround audio and matrix encode the five incoming channels 102 into two outgoing matrix encoded surround audio channels indicated by the designator 102'.

In certain embodiments, the matrix encoder 120 provides matrix encoding of multiple high-quality surround audio channels into two channel audio. The two channel audio can be efficiently transmitted, for example using any of a variety of compression formats available including but not limited to MP3, Real Audio, WMA, etc.

In one embodiment, the system 100 further comprises a digital encoder 122 arranged to receive the matrix encoded multi-channel surround audio 102' from the matrix encoder 120. The digital encoder 122 is further arranged to receive the incoming multiple dialog channels 104. The digital encoder 122 is further adapted to process the incoming multiple dialog channels 104 and matrix encode surround audio signals 102' for transmission via the transmission system 110. As previously noted, the transmission system 110 can be subject to bandwidth limitations indicated schematically by the designator 124. Thus, the digital encoder 122 encodes and appropriately compresses the multiple dialog channels 104 and matrix encoded surround audio channels 102' for transmission subject to the bandwidth limitations 124.

In one embodiment, the system 100 further comprises a digital decoder 126. The digital decoder 126 is generally arranged at a downstream or recipient location and provides a decoding function on the signals transmitted via the transmission system 110 to recreate the multiple dialog channels 104 and the matrix encoded surround audio channels 102' at a recipient location.

The decoded multiple dialog channels 104 and matrix encoded surround audio channels 102' are provided to a dialog select and mix module 130. The dialog select and mix module 130 generally comprises one or more user interfaces to allow a receiver or recipient to select their desired dialog. In various embodiments, such a user interface aspect can comprise one or more of a hand-held remote control, voice command capability, touch screen functionality, control buttons, or any other of a wide variety of known structures and processes for providing user control inputs to a system.

The module 130 is also adapted to mix the selected dialog channel 104 with the matrix encoded surround audio channels 102' to generate as output encoded surround audio mixed with the selected dialog channel. The output of the module 130 is indicated by the designator 132 and can be considered as a second plurality of surround audio channels 132 including the reconstructed center channel having the user selected dialog channel 104.

The encoded surround audio with dialog 132 is provided to a matrix decoder 134. The matrix decoder 134 is adapted to receive the incoming encoded surround audio with dialog 132 and to decode and reconstruct a corresponding multi-channel audio signal having the selected dialog indicated by the designator 136. The dialog select and mix module 130 together with the matrix decoder 134 can be considered as a dialog select and surround decode module 140. In one embodiment, the matrix decoder 134 comprises a 5.1 Circle Surround decoder and in this embodiment corresponds substantially to the complement of the Circle Surround matrix encoder 120.

It will be understood that in various implementations, processes performed by the system 100, such as encoding and compression of incoming signals can proceed substantially in a software based manner, in a hardware based manner, or in a combination of software and hardware based processes. Additional information, including various audio encoding and decoding enhancements, that can be advantageously employed with at least certain embodiments can be found in U.S. Pat. No. 5,771,295 "5-2-5 MATRIX SYSTEM" issued Jun. 23, 1998 and U.S. Pat. No. 7,200,236 "MULTI-CHANNEL AUDIO ENHANCEMENT SYSTEM FOR USE IN RECORDING AND PLAYBACK AND METHODS FOR PROVIDING SAME" issued Apr. 3, 2007 which are both incorporated herein by reference.

Figure 3:
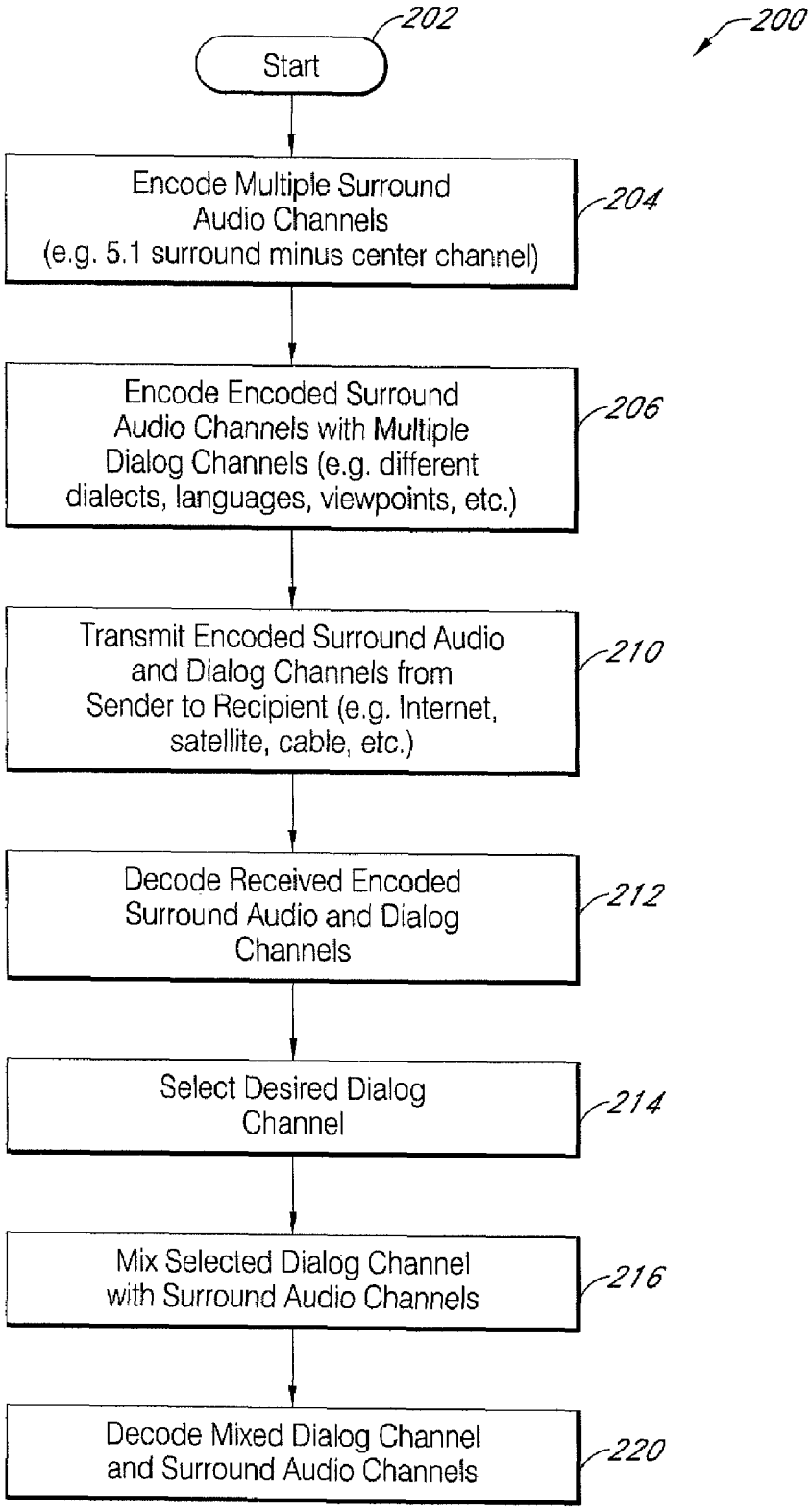
FIG. 3 is a flowchart of one embodiment of a multi-dialog surround audio process.

FIG. 3 is a flow chart of embodiments of a multi-dialog enhancement process 200. The process 200 begins in a start block 202 which can include for example the origination or generation of multi-channel surround sound audio content or programming. Following from the start block 202 is a block 204 wherein multiple surround audio channels are encoded. In one particular embodiment, the block 204 comprises encoding audio channels in a 5.1 Circle Surround format, however, with the center channel substantially removed therefrom. In one embodiment, the block 204 comprises a matrix encoding codec in a many to few manner. In one embodiment, the block 204 comprises matrix encoding five channels to two channels.

In a block 206, the encoded surround audio channels from block 204 are encoded with a plurality of different dialog channels. As previously noted, in various embodiments the multiple dialog channels can correspond to different languages, different dialects, different viewpoints, etc. In certain embodiments, the encoding of block 206 proceeds according to a many to few encoding codec. In one particular embodiment, block 206 proceeds according to a 5 channel encoding codec.

In a block 210, the encoded surround audio and dialog channels are transmitted from a sender to a recipient. As previously noted, the transmission of block 210 can proceed via a networked communication system, such as the Internet. The transmission of block 210 can also proceed via over the air broadcast transmissions, via fiber optic or cable transmission systems, and/or satellite-based transmission systems.

In a block 212, the transmitted encoded multi-channel audio signals of block 210 are received and decoded. Block 212 occurs in at least certain embodiments at a recipient location. The decoding of block 212 proceeds generally according to a few to many decoding codec and in one particular embodiment according to a 5 channel decoding codec.

In a block 214, a recipient indicates their desired dialog option. As previously noted, block 214 can proceed via actuation of a corresponding user control, speaking an appropriate command, selecting a desired icon or symbol on a display screen, or any of a variety of known processes for indicating and providing user control.

In a block 216, the selected dialog channel from block 214 is mixed with the surround audio channels. In one embodiment, block 216 comprises reconstructing surround audio channels with the selected dialog channel forming the center channel thereof.

In a block 220, the mixed dialog channel and surround audio channels are decoded to facilitate playback for the user. The decoding of block 220 generally proceeds in a few to many codec and in one embodiment according to a 2 to 5 decoding codec. The decoded dialog and surround audio channels can then be provided to known audio playback systems, such as the system 114 to recreate audio for the listener.

The process 200 provides the advantage of taking a plurality of surround audio channels and a plurality of dialog channels, in one embodiment five surround audio channels and three dialog channels, processing and transmitting these separate audio channels from a sender to a recipient, and recreating the separate audio channels such that the user can choose between the multiple dialog channels and experience surround sound audio with desired dialog. The process 200 provides the further advantage of transmitting signals from a sender to a recipient while accommodating bandwidth limitations of a transmission system. The process 200 also offers the advantage of recreating a surrounding sound or pseudo-sound experience for the listener including their choice of a variety of different dialog channels.

Although the above disclosed embodiments of the present teachings have shown, described and pointed out the fundamental novel features of the invention as applied to the above-disclosed embodiments, it should be understood that various omissions, substitutions, and changes in the form of the detail of the devices, systems and/or methods illustrated may be made by those skilled in the art without departing from the scope of the present teachings. Consequently, the scope of the invention should not be limited to the foregoing description but should be defined by the appended claims.

What is claimed is:

1. A process for communicating multi-channel audio data, the process comprising:

encoding with a first audio matrix encoder, a first plurality of surround audio channels to create a first pair of encoded audio channels, wherein the first pair of encoded audio channels have the first plurality of surround audio channels encoded therein;

encoding with a second audio matrix encoder, the first pair of encoded audio channels with a plurality of different language channels to create a second pair of encoded audio channels, wherein the second pair of encoded audio channels have the first plurality of surround audio channels and the plurality of different language channels encoded therein;

transmitting the second pair of encoded audio signals from a sender to a recipient;

decoding with a first matrix decoder the second pair of encoded audio signals to generate the first pair of encoded audio signals and the plurality of different language channels;

decoding with a second matrix decoder the first pair of encoded audio signals to generate the first plurality of surround audio channels;

selecting at least one of the different language channels; and mixing the at least one selected language channel with the decoded surround audio channels to obtain a second plurality of surround audio channels, the second plurality of surround audio channels including the selected language channel.

2. The process of claim 1, further comprising:

matrix encoding the first plurality of surround audio channels in a many to few encoding codec and encoding the few matrix encoded surround audio channels with the plurality of different language channels.

3. The process of claim 2, comprising matrix encoding the first plurality of surround audio channels according to a many to two codec.

4. The process of claim 2, comprising matrix encoding the first plurality of surround audio channels according to a Circle Surround codec.

5. The process of claim 1, wherein the encoding the first plurality of surround audio channels is performed with dialog channels removed therefrom and wherein the plurality of different language channels is subsequently encoded with the encoded first plurality of surround audio channels.

6. The process of claim 1, wherein the selecting at least one of the different language channels can be performed during the transmitting of the encoded first plurality of surround audio channels without interruption of the transmitting.

7. A multi-channel audio transmission system comprising:

a first sender multi-channel encoder executing in one or more processors, wherein the first sender multi-channel encoder is configured to encode a plurality of surround audio channels to create a first pair of encoded channels, wherein the first pair of encoded channels have the first plurality of surround audio channels encoded therein; and a second multi-channel encoder executing on one or more processors, wherein the second multi-channel encoder is configured to encode the first pair of encoded channels with a plurality of different dialog channels to create a second pair of encoded channels, wherein the second pair of encoded channels have the first plurality of surround audio channels and the plurality of different dialog channels encoded therein.

8. The system of claim 7, wherein the second sender encoder comprises a matrix encoder.

9. The system of claim 8, wherein the second sender encoder comprises a Circle Surround matrix encoder.

10. The system of claim 8, wherein the first sender matrix encoder is arranged to receive the plurality of surround audio channels as input and is configured to output two channels of matrix encoded surround audio.

11. The system of claim 10, wherein the sender encoder is adapted to compress the two channels of matrix encoded surround audio and the plurality of dialog channels into the second pair of encoded channels for transmission by the transmission system.

12. The system of claim 7, wherein the transmission system comprises a networked communication system.

13. The system of claim 12, wherein the transmission system comprises an Internet streaming system.

14. The system of claim 7, wherein a recipient decoder comprises a user interface configured such that a recipient user can select a desired dialog channel.

15. The system of claim 7, wherein the first sender encoder is adapted to matrix encode n surround audio channels into 2 matrix encoded surround audio channels and wherein a recipient decoder is adapted to receive the 2 matrix encoded surround audio channels and the plurality of dialog channels and to generate n+1 surround audio channels, the n+1 surround audio channels including a center channel having a selected dialog channel.

16. A multi-channel audio transmission system comprising:

first means for encoding a first plurality of surround audio channels to create a first pair of encoded channels, wherein the first pair of encoded channels have the first plurality of surround audio channels encoded therein;

second means for encoding the first pair of encoded channels with a plurality of different dialog channels to create a second pair of encoded channels, wherein the second pair of encoded channels has the first plurality of surround audio channels and the plurality of different dialog channels encoded therein.

17. The system of claim 16, wherein the first means for encoding comprises a Circle Surround matrix encoder.

18. The system of claim 16, wherein the means for transmitting comprises an over the air broadcast system.

19. The system of claim 16, further comprising a means for selecting and mixing allows a user to designate a selected dialog channel during playback of the first plurality of surround audio channels.

20. The system of claim 19, wherein the means for selecting and mixing comprises a matrix decoder adapted to combine the selected dialog channel with decoded first plurality of surround audio channels such that the decoded first plurality of surround audio channels comprises the selected dialog channel as a center channel.

* * * * *